US008129662B2

(12) United States Patent
Cameron et al.

(10) Patent No.: US 8,129,662 B2
(45) Date of Patent: Mar. 6, 2012

(54) PORTABLE HEATER

(75) Inventors: Norman Cameron, Kimberling City, MO (US); Dennis Cook, Shippensburg, PA (US)

(73) Assignee: Reliable Products International, Chambersburg, PA (US)

( * ) Notice: Subject to any disclaimer, the term of this patent is extended or adjusted under 35 U.S.C. 154(b) by 490 days.

(21) Appl. No.: 12/348,999

(22) Filed: Jan. 6, 2009

(65) Prior Publication Data

US 2010/0032424 A1 Feb. 11, 2010

(51) Int. Cl.
*F24C 7/10* (2006.01)
*F24F 3/04* (2006.01)

(52) U.S. Cl. ..... 219/386; 165/123; 165/179; 165/185; 126/110 R; 392/375; 392/376; 392/503; 392/356; 392/363; 392/364; 392/365; 392/369; 392/492; 392/410

(58) Field of Classification Search ..... 392/375–6, 392/503, 356, 363–369, 492, 410; 126/110 R; 165/123, 179, 185; 219/386
See application file for complete search history.

(56) References Cited

U.S. PATENT DOCUMENTS 1,649,605 A * 11/1927 Ljungstrom et al. ..... 126/110 R
6,327,427 B1 * 12/2001 Burkett ..... 392/369
7,046,918 B1 5/2006 Burkett et al.
2006/0110141 A1 5/2006 Burkett et al.

* cited by examiner

*Primary Examiner* — Shawntina Fuqua
(74) *Attorney, Agent, or Firm* — The Ollila Law Group LLC

(57) ABSTRACT

A portable heater (100) is provided. The portable heater (100) comprises an air inlet (108) and an air outlet (118). The portable heater (100) also comprises a heating chamber (115) including one or more heating elements (230). A preheating chamber (114) is provided that is located between the air inlet (108) and a heating chamber inlet (116).

20 Claims, 3 Drawing Sheets

PORTABLE HEATER

TECHNICAL FIELD

The present invention relates to a heater, and more particularly, to a portable heater with a preheating airflow path.

BACKGROUND OF THE INVENTION

With the increasing concerns regarding energy costs, many individuals are looking for economical alternatives to meet heating demands. One approach has been to limit the area heated with the use of portable/space heaters. Portable heaters are generally designed to heat a smaller area such as a room or a couple of rooms, but normally are not intended to heat an entire dwelling. However, portable heaters are known that are capable of heating relatively large areas such as 800-1000 square feet, for example. In addition, as the name implies, portable heaters can usually be moved from one location to another with relative ease. Therefore, if a user moves from one area to another, the portable heater can also be moved. The use of portable heaters allows users to control the local room temperature without incurring the increased heating costs of maintaining the entire house or office at a desired temperature.

Although various sources of energy are available for portable heaters, many indoor units are electrically powered and include an electrically powered radiant heating element. Fuel burning units are known, such as kerosene heaters, however, such units require additional ventilation to prevent fumes from rising to a dangerous level. Electrically powered units come in various configurations and the heating elements typically comprise high resistance wiring or quartz halogen lamps, for example. Other configurations are known and each heating element includes specific advantages. Therefore, the particular heating element chosen may depend on the power requirements as well as the desired temperature range capable of each heating element.

Typical prior art portable heaters also include an airflow generator, such as a fan to draw ambient air from the environment and pass the air over the heating element before discharging the heated air to the surrounding area. The ambient air may be substantially colder than the desired temperature and a single pass over the heating element often requires extended periods of time to raise the room temperature to the desired temperature.

Therefore, there is a need in the art to provide a portable heater that can adequately warm the local air to a desired temperature in a relatively short amount of time. The present invention solves this and other problems and an advance in the art is achieved. The present invention provides a portable heater that includes an airflow path that warms incoming air prior to reaching the heating element. The heating elements can therefore increase the temperature of the output air more than realized in the prior art.

SUMMARY OF THE INVENTION

A portable heater is provided according to an embodiment of the invention. The portable heater comprises an air inlet and an air outlet. A heating chamber is provided that includes one or more heating elements. The portable heater also includes a preheating chamber located between the air inlet and a heating chamber inlet.

A portable heater is provided according to another embodiment of the invention. The portable heater comprises a frame including an air inlet and an air outlet. The portable heater also includes a preheating chamber and a heating chamber. At least a portion of the heating chamber is positioned within the preheating chamber.

Aspects

Preferably, the portable heater further comprises one or more airflow generators communicating with the air inlet and the air outlet.

Preferably, the portable heater further comprises an air filter positioned proximate the air inlet.

Preferably, the portable heater further comprises one or more temperature sensors.

Preferably, the heating chamber inlet faces away from the air inlet.

Preferably, the portable heater further comprises a heating chamber inlet guard.

Preferably, at least a portion of the heating chamber is positioned within the preheating chamber.

Preferably, the portable heater further comprises an airflow path from the inlet, through the preheating chamber, through the heating chamber inlet, the heating chamber, to the outlet.

Preferably, the portable heater further comprises one or more heating elements in the heating chamber.

Preferably, the portable heater further comprises a heating chamber inlet located such that air in the portable heater flows through at least a portion of the preheating chamber prior to entering the heating chamber inlet.

Preferably, the heating chamber is offset from the frame.

DETAILED DESCRIPTION OF THE INVENTION

Figure 1:
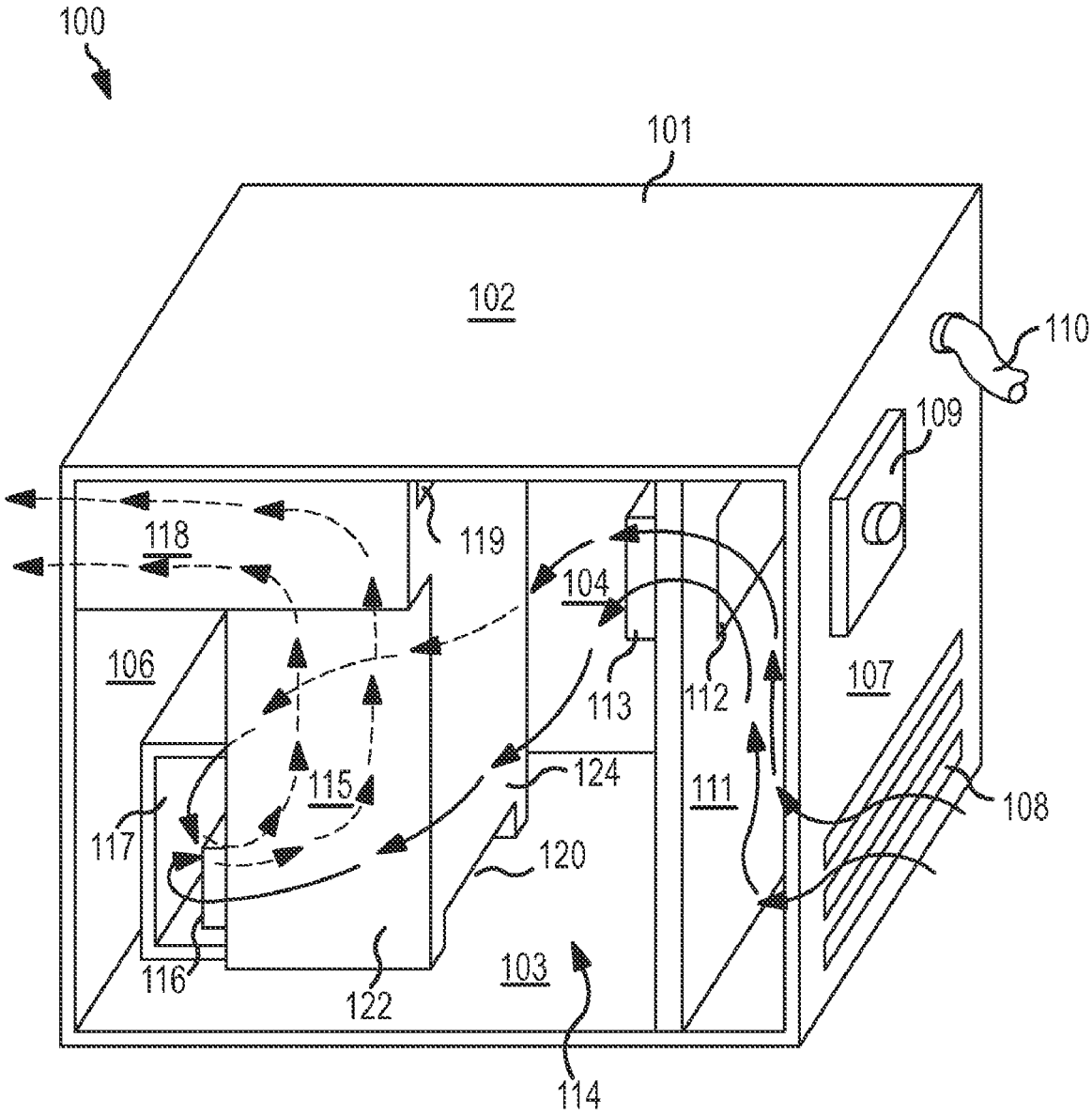
FIG. 1 shows a portable heater according to an embodiment of the invention.
Figure 2:
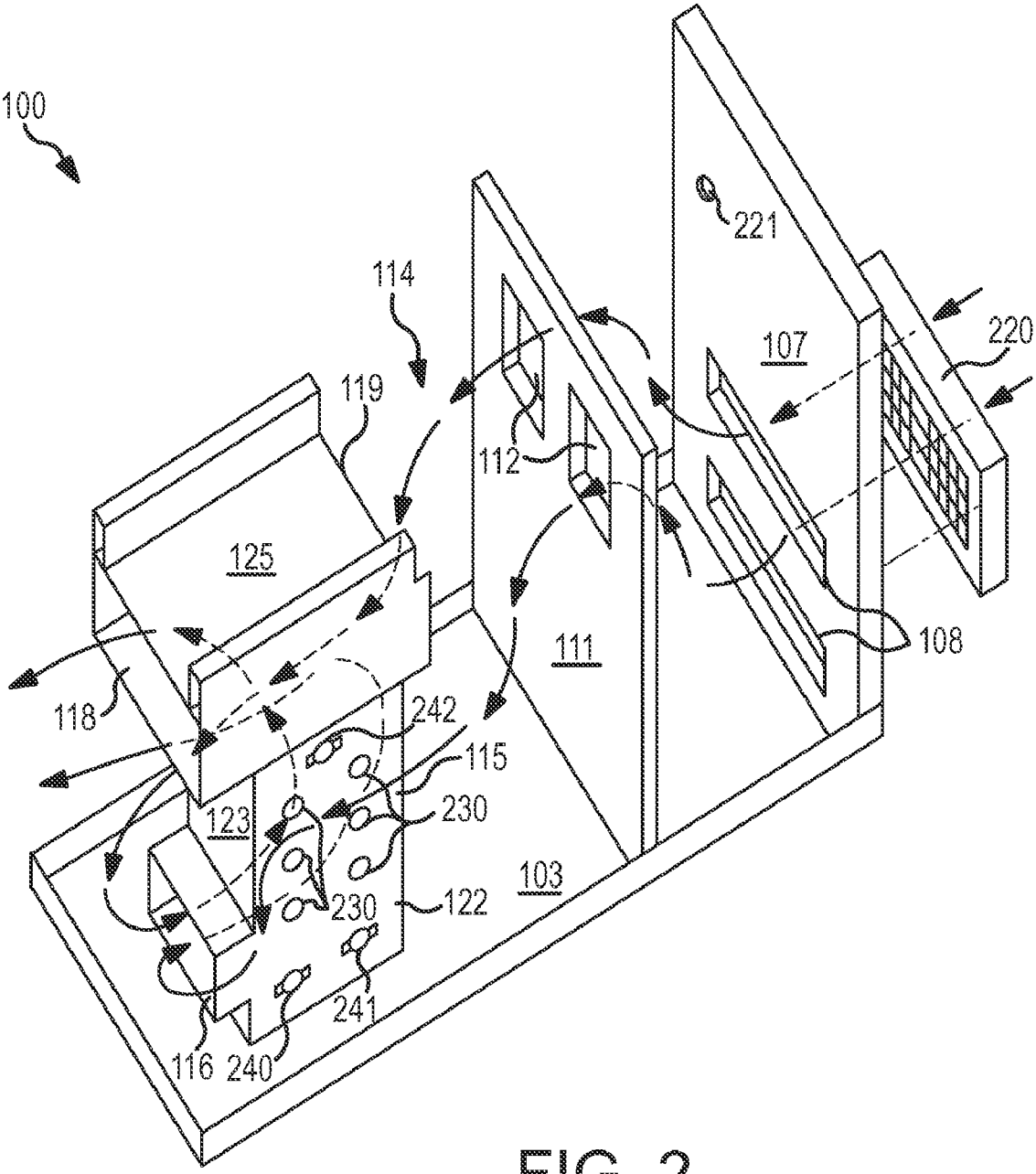
FIG. 2 shows the portable heater according to another embodiment of the invention.
Figure 3:
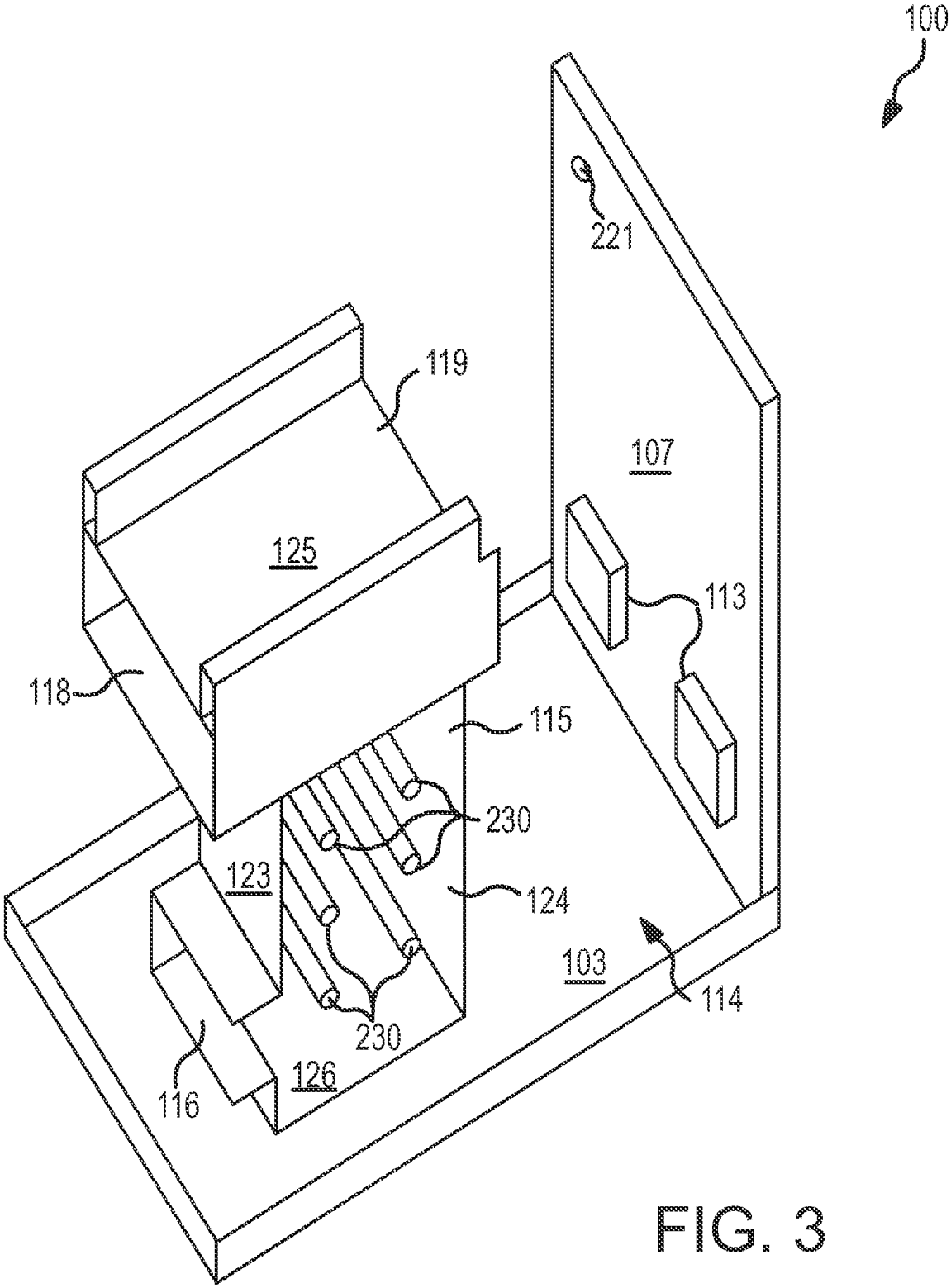
FIG. 3 shows the portable heater according to yet another embodiment of the invention.

FIGS. 1-3 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

FIG. 1 shows a partially exposed portable heater 100 according to an embodiment of the invention. It should be appreciated that in use, the inside portion of the portable heater 100 is enclosed with a side panel 105, which is removed in FIG. 1 and, in some embodiments, a wood casing. The portable heater 100 includes an exterior frame 101. The frame 101 may comprise a single piece of material or may be formed using multiple panels coupled together. In the example shown in FIG. 1, the frame 101 comprises a top panel 102, a bottom panel 103, a first side panel 104, a second side panel 105 (not shown), a front panel 106, and a back panel 107. It should be appreciated that the orientation used should not limit the scope of the invention, but rather is used for the purposes of clarity and simplicity of understanding the portable heater 100. The frame 101 may comprise any suitable material, for example, metal, such as stainless steel or aluminum; high temperature plastic; ceramic; wood; etc. The various pieces of the frame 101 may be coupled together using fasteners, such as screws or nails, adhesives, bonding, welding, brazing, etc. The particular method of coupling the frame 101 together is not important for the purposes of the present invention and therefore, should not limit the scope of the invention.

As shown in FIG. 1, the back 107 includes an air inlet 108. The air inlet 108 shown comprises a grill; however, other configurations are contemplated and are within the scope of the invention. The portable heater 100 may also include a filter member 220 (See FIG. 2). The back 107 also includes a temperature controller 109 and an electrical cord 110. The temperature controller 109 may comprise a digital or analog controller and may be coupled to interior circuitry to adjust the desired temperature. The electrical cord 110 may be provided to supply the portable heater 100 with power. According to another embodiment, the portable heater 100 may be powered by other means, such as a battery, solar panels, fuel cells, etc. Therefore, the present invention should not be limited to external energy sources to provide the electricity to operate the portable heater 100.

According to an embodiment of the invention, the portable heater 100 also includes an air flow support panel 111. The air flow support panel 111 can include one or more apertures 112. An air flow generator 113 can be positioned within each of the apertures 112. The airflow support panel 111 can create a tortuous airflow path that can reduce the noise of the portable heater 100, for example. The air flow generator 113 may comprise a fan, for example. However, the air flow generator 113 may also comprise an electrostatic device, a compressor, a pump, etc. Therefore, the present invention should not be limited to requiring a fan. According to an embodiment of the invention, the portable heater 100 includes more than one air flow generator 113. Therefore, more than one air flow generator 113 may be used to increase the air flow through the portable heater 100. According to an embodiment of the invention, the air flow support panel 111 can extend from the top panel 102 to the bottom panel 103 and from the first side panel 104 to the second side panel 105. Therefore, substantially all of the air flowing through the portable heater 100 travels through the aperture 112 and the air flow generator 113.

According to an embodiment of the invention, the portable heater 100 includes a preheating chamber 114 and a heating chamber 115. According to an embodiment of the invention, at least a portion of the heating chamber 115 is positioned within the preheating chamber 114. In some embodiments, the entire heating chamber 115 is positioned within the preheating chamber 114. Therefore, the heat radiating from the heating chamber 115 can be used to warm the preheating chamber 114 as discussed below. It should be understood however, that the heating chamber 115 does not need to be positioned within the preheating chamber 114. Therefore, the specific configuration shown in the figures should not limit the scope of the invention.

The heating chamber 115 can include an inlet 116 to receive pre-heated air. In addition, the portable heater 100 can include a heating chamber guard 117. The heating chamber guard 117 can be positioned around the heating chamber inlet 116 to restrict the incoming air flow path. Furthermore, the heating chamber guard 117 can reduce the heat radiating from the heating chamber inlet 116 to the front panel 106. This prevents the front panel 106 from overheating. The heating chamber 115 can also include an outlet 118 to exhaust the heated air to the surrounding area. In addition, the portable heater 100 may include gaps 119, 120 between the top of the heating chamber 115 and the top panel 102, and the bottom of the heating chamber 115 and the bottom panel 103, respectively. The gaps 119, 120 can offset the heating chamber 115 from the panels 102, 103 to reduce the heat radiated to the top and bottom panels 102, 103 to prevent the panels from overheating. Furthermore, as shown, in some embodiments, the heating chamber 115 is not as wide as the portable heater 100. Therefore, the heating chamber 115 is not in direct contact with the frame 101. Furthermore, the air can flow around the sides of the heating chamber 115. Therefore, in addition to preheating the air, the preheating chamber 114 can create an insulating barrier between the heating chamber 115 and the frame 101. This can substantially reduce the temperature of the frame 101, thereby allowing the frame 101 to be placed within a casing, such as a wood casing, for example.

The heating chamber 115 may be formed from a single piece of material, such as metal, or alternatively, the heating chamber 115 may be formed from a plurality of panels 121, 122, 123, 124, 125, and 126 coupled together in a similar manner as the frame 101. Furthermore, the particular shape of the heating chamber 115 is not important for the purposes of the present invention. Therefore, although the heating chamber 115 is shown as comprising a substantially cube shape, it should be appreciated that other shapes are contemplated and are within the scope of the invention. According to an embodiment of the invention, the heating chamber 115 is formed from a material having a relatively moderate rate of heat transfer. In other words, the heating chamber 115 is not formed from a highly insulating material. Therefore, heat generated by the heating elements 230 within the heating chamber 115 can be conducted through the walls of the heating chamber 115 and into the preheating chamber 114.

According to an embodiment of the invention, the heating chamber inlet 116 and the air guard 117 can be positioned such that after air enters the preheating chamber 114, it travels around the heating chamber 115, contacting the exterior of the heating chamber 115 prior to entering the heating chamber inlet 116. This airflow path is shown by the arrows. As shown, the air enters the portable heater 100 through the air inlet 108, through the preheating chamber 114, into the heating chamber inlet 116, through the heating chamber 115, and exhausts through the air outlet 118. When in the preheating chamber 114, the air flows around the heating chamber 115 between the heating chamber 115 and the first side panel 104 as well as between the heating chamber 115 and the second side panel 105. As shown, in some embodiments, the heating chamber inlet 116 can be positioned substantially opposite the air inlet 108.

Once the heating elements 230 are turned on and the heating chamber 115 is heated, the sides of the heating chamber 115 will also be heated. Therefore, heat radiating from the heating chamber 115 can pre-heat the air in the preheating chamber 114. Because the heating chamber inlet 116 is located opposite the air inlet 108 and airflow generator 113, the air circulates through the preheating chamber 114 and around the heating chamber 115 prior to entering the heating chamber inlet 116. This substantially increases the efficiency of the portable heater 100 as the temperature of the air entering the heating chamber 115 has already increased from the ambient room temperature.

After the air is pre-heated by flowing around the outside of the heating chamber 115 in the preheating chamber 114, the air can enter the heating chamber 115 through the heating chamber inlet 116. Once in the heating chamber 115, the air temperature is increased further by the heating elements 230 located within the heating chamber 115. The heating elements 230 also heat the heating chamber panels 121, 122, 123, 124, 125, and 126, which warms the preheating chamber 114. The heated air exits the heating chamber 115 and the portable heater 100 through the air outlet 118. According to an embodiment of the invention, a space 119 is provided on the top of the air outlet 118 that separates the air outlet 118 from the top panel 102 of the frame 101. In addition, a space 120 can be provided between the bottom panel 126 of the heating chamber 115 and the bottom panel 103 of the frame 101. The spaces 119, 120 can be provided to prevent the top panel 102 and the bottom panel 103 from overheating. Therefore, the frame 101 can be placed within a casing, such as a casing for aesthetic appeal without the danger of the material overheating and burning, charring, or causing the casing to become hot and dangerous to touch. The casing may be made from wood, plastic, metal, or any other suitable material known in the art.

FIG. 2 shows the portable heater 100 according to an embodiment of the invention. Some of the components of the portable heater 100 are removed in FIG. 2 in order to simplify the figure. However, it should be understood that in operation, the omitted components would be present. In addition, FIG. 2 includes components of the portable heater 100 not shown in FIG. 1, for example, the filter 220, power cord aperture 221, heating elements 230, and temperature sensors 240.

In operation, the portable heater 100 can be turned on using a switch (not shown) located on the front panel 106 of the portable heater 100. The switch may be connected to circuitry (not shown) of the portable heater 100. The circuitry can be powered via the power cord 110. It should be understood that other methods are contemplated for turning the portable heater 100 on and the use of a switch is merely one example. Once the portable heater is turned on, the heating elements 230 are powered, whereby they begin to heat. According to an embodiment of the invention, there is a delay before power is supplied to the airflow generators 113. For example, the airflow generators 113 may remain off for a predetermined amount of time after power has been supplied to the heating elements 230. According to another embodiment of the invention, the airflow generators 113 may remain off until the temperature within the heating chamber 115 reaches a predetermined temperature, measured by the temperature sensors 240, for example. Providing a delay between powering the heating elements 230 and powering the airflow generator 113 can provide a number of advantages. One advantage is that cold air is not exhausted from the portable heater 100 prior to the heating chamber 114 becoming fully heated. Another advantage is that the delay can allow the heating chamber 115 to fully heat up and therefore, also warm the preheating chamber 114. According to yet another embodiment of the invention, both the heating elements 230 as well as the airflow generator 113 can be powered substantially simultaneously.

Once, the airflow generators 113 are turned on, air enters the portable heater 100 through the filter 220 and air inlet 108. Air then travels through the apertures 112 and airflow generators 113 into the preheating chamber 114 where the air is heated to a first raised temperature as the air circulates around the heating chamber 115. The first raised temperature may be determined based on how long the portable heater 100 has been powered. In other words, the first raised temperature may be determined by how long the heating elements 230 have been heating the heating chamber 115. The first raised temperature may also depend upon the material used to form the heating chamber 115. The preheated air then enters the heating chamber 115 through the heating chamber inlet 116. A temperature sensor 240 at the heating chamber inlet 116 can determine the temperature of the incoming air and thus, the temperature of the air within the preheating chamber 114. It should be appreciated that the heating elements 230 as well as the temperature sensors 240 may be connected to appropriate circuitry (not shown). The temperature sensor 240 may also be able to indicate an approximate temperature in the area surrounding the portable heater 100. For example, the electronics of the portable heater 100 may be calibrated to determine an approximate surrounding temperature based on the temperature within the preheating chamber 114.

The preheated air then travels through the heating chamber 115 where it is heated to a second raised temperature by the heating elements 230. According to an embodiment of the invention, the heating chamber 115 comprises one or more heating element 230. In the embodiment shown, the heating chamber 115 comprises six heating elements 230; however, it should be understood that any number of heating elements 230 may be used and the particular number should not limit the scope of the invention. Furthermore, according to an embodiment of the invention, the number of heating elements 230 actually powered may be controlled. In some embodiment, the number of heating elements 230 powered may be controlled using the temperature controller 109; however, in other embodiments, the number of heating elements 230 powered may be controlled using a separate heating element controller (not shown). The number of heating elements 230 powered may be controlled for a number of reasons. For example, substantially all of the heating elements 230 (six as shown in the figures) may be powered initially to provide a relatively fast increase in room temperature. Once the temperature of the room is at or near the desired temperature, one or more of the heating elements 230 may be turned off to provide a lower output temperature that may maintain the temperature of the room using less power, for example.

According to an embodiment of the invention, each of the heating elements 230 is approximately 250 watts. However, the particular power demands of the heating elements 230 should not limit the scope of the present invention. According to an embodiment of the invention, the heating elements 230 extend substantially entirely across the heating chamber 115. In the embodiment shown, the heating elements 230 extend from side to side rather than front to back across the heating chamber 115. However, it should be understood that in other embodiments, the heating elements 230 can extend from front to back, top to bottom, or any other configuration desired.

According to an embodiment of the invention, the heated air finally exits the portable heater 100 through the air outlet 118 at the top of the heating chamber 115. A temperature sensor 242 located near the exit of the heating chamber 115 can measure the temperature of the air exiting the portable heater 100. Although the temperature sensor 242 is shown near the top of the heating chamber 115, it should be appreciated that in other embodiments, the temperature sensor 242 can positioned in other locations of the heating chamber 115, such as between the heating elements 230, for example.

According to an embodiment of the invention, the temperature sensors 240, 241, 242 can be used to control power to the heating elements 230 as well as the airflow generators 113. According to one embodiment of the invention, the temperature sensors 240, 241 can be used to control power to the heating elements 230 while the temperature sensor 242 can be used to control power to the airflow generators 113. It should be appreciated that the particular temperature sensors used to control the various components of the heater 100 should not limit the scope of the invention as the configuration is provided merely as an example.

According to an embodiment of the invention, in the event that the heating elements 230 or the heating chamber 115 overheats, the temperature sensors 240, 241 can measure the increased temperature and turn off the heating elements 230.

According to another embodiment of the invention, the temperature sensor 242 can be used to determine when to turn on the airflow generators 113 after power has been provided to the heating elements 230. For example, the temperature sensors 240, 241 can measure a temperature within the heating chamber 115. Once the temperature within the heating chamber 115 reaches a threshold temperature, electronics (not shown) within the portable heater 100 can turn on the airflow generators 113. The threshold temperature may be determined, for example, based on the thermostatic temperature determined by a user using the temperature controller 109.

According to another embodiment of the invention, the airflow generator 113 may remain turned on even after a user has turned the unit off. For example, turning off the unit may only turn off the heating elements 230. However, even after the heating elements 230 are turned off, the heating elements 230 may remain hot. Therefore, the airflow generator 113 may remain on and circulate air through the portable heater 100 until the temperature within the heating chamber 115, measured by the temperature sensor 242 drops to a threshold temperature. The circulating air caused by the airflow generator 113 may reduce the time required to drop the temperature of the heating chamber below the threshold temperature. Furthermore, circulating the air after the heating elements 230 have been turned off may maintain the life of the heating elements 230.

According to another embodiment of the invention, a temperature sensor 242 may be used to determine the exhaust air temperature. Once the exhaust air temperature reaches a threshold temperature, the heater's circuitry can turn off the heating elements 230. In some embodiments, the airflow generator 113 may remain on and circulate air through the unit. In other embodiments, the airflow generator 113 may remain on as long as the user has not turned the unit off.

FIG. 3 shows the portable heater 100 according to another embodiment of the invention. As in the previous figures, many of the components have been removed in order to view the interior of the portable heater 100. The embodiment shown in FIG. 3 comprises a more condensed portable heater 100. As can be seen, the airflow support panel 111 has been removed and the airflow generators 113 are coupled to the back panel 107. Therefore, air enters the portable heater 100 through the air inlet 108 and directly into the airflow generators 113. In some embodiments, this may create a slightly louder portable heater 100 as the airflow is not as tortuous as in the embodiments shown in FIGS. 1 and 2. However, the portable heater 100 shown in FIG. 3 can be produced at a reduced cost because of the elimination of the airflow support panel 111.

Additionally shown in FIG. 3 is the interior of the heating chamber 115. As shown, the heating elements 230 extend across substantially the entire heating chamber 115. Therefore, the air flows around the heating elements 230 as it flows through the heating chamber 115. This direct contact with the heating elements 230 can increase the temperature of the air substantially. It should be appreciated that in other embodiments, the heating elements 230 may not extend across the entire heating chamber 115.

The portable heater 100 as discussed above provides a more efficient heater that can increase the temperature of air exiting the heater 100 more than realized in the prior art. Advantageously, the portable heater 100 includes a heating chamber 115 including one or more heating elements 230. The heating elements 230 may be energized in any number of ways including, but not limited to, electricity. Unlike prior art portable heaters where air simply enters the heating chamber without any prior heating, the portable heater 100 of the present invention provides a preheating chamber 114 that can advantageously increase the temperature of the incoming air prior to entering the heating chamber 115. According to an embodiment of the invention, at least a portion of the heating chamber 115 is positioned within the preheating chamber 114. Therefore, the preheating chamber 114 can be heated by the exterior of the heating chamber 115. Therefore, the preheating chamber 115 does not require an additional heat source.

In addition to the benefits of preheating the air provided by the preheating chamber 114, the preheating chamber 114 also provides the added benefit of providing an insulating barrier between the heating chamber 115 and the frame 101 of the portable heater 100. Therefore, the temperature of the frame 101 of the portable heater 100 is reduced during use and can be placed in a casing made from wood, for example without the danger of fire.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other portable heaters, and not just to the embodiments described above and shown in the accompanying figures. Accordingly, the scope of the invention should be determined from the following claims.

We claim:

1. A portable heater (100), comprising:

an air inlet (108) and an air outlet (118);

a heating chamber (115) including one or more heating elements (230); and a preheating chamber (114) located between the air inlet (108) and a heating chamber inlet (116), wherein at least a portion of the heating chamber (115) is positioned within the preheating chamber (114).

2. The portable heater (100) of claim 1, further comprising one or more airflow generators (113) communicating with the air inlet (108) and the air outlet (118).

3. The portable heater (100) of claim 1, further comprising an air filter (220) positioned proximate the air inlet (108).

4. The portable heater (100) of claim 1, further comprising one or more temperature sensors (240, 241, 242).

5. The portable heater (100) of claim 1, wherein the heating chamber inlet (116) faces away from the air inlet (108).

6. The portable heater (100) of claim 1, further comprising a heating chamber inlet guard (117).

7. The portable heater (100) of claim 1, further comprising an airflow path from the inlet (108), through the preheating chamber (114), through the heating chamber inlet (116), the heating chamber (115), to the outlet (118).

8. A portable heater (100), comprising:

a frame (101), including an air inlet (108) and an air outlet (118);

a preheating chamber (114);

a heating chamber (115), with at least a portion of the heating chamber (115) positioned within the preheating chamber (114); and a heating chamber inlet (116) located such that air in the portable heater (100) flows through at least a portion of the preheating chamber (114) prior to entering the heating chamber inlet (116).

9. The portable heater (100) of claim 8, further comprising one or more heating elements (230) in the heating chamber (115).

10. The portable heater (100) of claim 8, further comprising one or more temperature sensors (240, 241, 242).

11. The portable heater (100) of claim 8, further comprising a heating chamber inlet guard (117).

12. The portable heater (100) of claim 8, further comprising one or more airflow generators (113) communicating with the air inlet (108) and the air outlet (118).

13. The portable heater (100) of claim 8, wherein the heating chamber (115) is offset from the frame (101).

14. The portable heater (100) of claim 8, further comprising an airflow path from the inlet (108), through the preheating chamber (114), through a heating chamber inlet (116), the heating chamber (115), to the outlet (118).

15. The portable heater (100) of claim 8, further comprising an air filter (220) positioned proximate the air inlet (108).

16. A portable heater (100), comprising:

an air inlet (108) and an air outlet (118);

a heating chamber (115) including one or more heating elements (230); and a preheating chamber (114) located between the air inlet (108) and a heating chamber inlet (116);

wherein the heating chamber inlet (116) faces away from the air inlet (108).

17. The portable heater (100) of claim 16, further comprising one or more airflow generators (113) communicating with the air inlet (108) and the air outlet (118).

18. The portable heater (100) of claim 16, further comprising one or more temperature sensors (240, 241, 242).

19. The portable heater (100) of claim 16, further comprising a heating chamber inlet guard (117).

20. The portable heater (100) of claim 16, further comprising an airflow path from the inlet (108), through the preheating chamber (114), through the heating chamber inlet (116), the heating chamber (115) to the outlet (118).

* * * * *